United States Patent [19]

Koshinaka et al.

[11] Patent Number: 4,799,440

[45] Date of Patent: Jan. 24, 1989

[54] LOOPER CHANGEOVER DEVICE

[75] Inventors: Osamu Koshinaka; Yoshikazu Suzuki; Yoshihide Yoneda, all of Osaka, Japan

[73] Assignee: Maruzen Sewing Machine Co., Ltd., Osaka, Japan

[21] Appl. No.: 397,072

[22] Filed: Jul. 12, 1982

[30] Foreign Application Priority Data

Aug. 11, 1981 [JP] Japan ..... 56-126087

[51] Int. Cl.[4] ..... D05B 57/06

[52] U.S. Cl. ..... 112/162; 112/199

[58] Field of Search ..... 112/16, 162, 166, 168, 112/199

[56] References Cited

U.S. PATENT DOCUMENTS

| | | | |
|---|---|---|---|
| 425,722 | 4/1890 | Amborn, Jr. | 112/54 |
| 591,383 | 10/1897 | Collins | 112/162 |
| 703,812 | 7/1902 | Onderdonk | 112/166 |
| 836,250 | 11/1906 | Haase | 112/157 |
| 967,804 | 8/1910 | Merritt et al. | 112/162 |
| 1,293,560 | 2/1919 | Seymour | 112/162 |
| 1,304,861 | 5/1919 | Dubois et al. | 112/162 |
| 1,443,084 | 1/1923 | Moffatt et al. . | |
| 1,548,909 | 8/1925 | Seymour . | |
| 1,640,201 | 8/1927 | Maier | 112/162 |
| 1,663,488 | 3/1928 | Berger . | |
| 1,748,052 | 2/1930 | Becker . | |
| 1,769,058 | 7/1930 | Gruman . | |
| 1,864,391 | 6/1932 | Zeier . | |
| 1,864,393 | 6/1932 | Zeier et al. . | |
| 1,929,323 | 10/1933 | Maier . | |
| 2,023,693 | 3/1936 | Duke | 112/162 |
| 2,033,316 | 12/1935 | Ebert | 112/162 |
| 2,046,928 | 7/1936 | Riviere et al. | 112/199 |
| 2,439,332 | 4/1948 | Becker | 112/199 |
| 2,482,079 | 9/1949 | Zeier | 112/199 |
| 2,812,735 | 11/1957 | Nelson | 112/199 |
| 3,065,717 | 11/1962 | Reimer | 112/165 |
| 3,116,706 | 1/1964 | Sigoda | 112/162 |
| 3,121,413 | 2/1964 | Sigoda | 112/200 |
| 3,353,510 | 11/1967 | Reeber et al. | 112/162 |
| 3,373,706 | 3/1968 | Arnstead, Jr. | 112/162 |
| 3,395,660 | 8/1968 | Lewis, Jr. et al. | 112/123 |
| 3,563,194 | 2/1971 | Conti | 112/199 X |
| 3,610,187 | 10/1971 | Fukutomi et al. | 112/162 |
| 3,670,677 | 6/1972 | Hirayama | 112/199 |
| 3,753,410 | 8/1973 | Kostenowczyk | 112/199 |
| 3,885,509 | 5/1975 | Cox | 112/162 X |
| 3,952,674 | 4/1976 | Hirayama | 112/199 |
| 4,117,792 | 10/1978 | Navlyt | 112/433 |
| 4,237,804 | 12/1980 | Hirayama | 112/168 |
| 4,267,786 | 5/1981 | Hanyu et al. | 112/168 |

*Primary Examiner*—W. C. Reynolds

*Attorney, Agent, or Firm*—Welsh & Katz, Ltd.

[57] ABSTRACT

A looper changeover device for a sewing maching capable of making overlocked stitches is improved by having a manually operable, rotatable selector mechanism for securing and selectively positioning a looper with respect to a looper holder and a looper driving mechanism between a first position and a second position wherein the looper can be moved along separate paths for the selective production of overlocked stitches with one needle and three threads or one needle and two threads. The rotatable selector mechanism can include a rotatable disk or dial supported by the holder and engaging a portion of the looper for positioning and securing the looper in either of the first and second positions.

7 Claims, 2 Drawing Sheets

LOOPER CHANGEOVER DEVICE

BACKGROUND OF THE INVENTION

The present invention relates to an overlocking sewing machine, and more particularly to a looper changeover device for an overlocking sewing machine capable of forming overlocked stitches with one needle and two threads and one needle and three threads.

Conventional overlocking sewing machines for producing overlocked stitches with one needle and three threads include a sewing needle, a lower looper and an upper looper secured to a looper holder, which cooperate to form such overlocked stitches. Overlocking sewing machines for forming overlocked stitches with one needle and two threads have a sewing needle, a lower looper and a spreader, which are cooperatively actuatable to produce the described overlocked stitches.

Recently, a sewing machine was proposed in U.S. Pat. No. 4,237,804 for stitching fabric edges with an overlocked stitch with one needle and three threads, the sewing machine including an upper looper and a separate movable member attached thereto, which together define a hook portion for overcasting a fabric edge with one needle and two threads as with a single spreader. When forming overlocked stitches with one needle and three threads, the movable member is brought away from the upper looper to release the hook portion and allow the upper looper to function as intended. In this machine, the combined hook portion moves along the same path as that of the upper looper when forming overlocked stitches with one needle and three threads, so that the hook portion and the upper looper will meet a lower looper at the same position to produce the respective stitches. The separate movable member which is necessary to cooperate with the upper looper in providing the combined hook portion for formation of overlocked stitches with one needle and two threads must be retracted, when not in use, into a position in which the movable member does not interfere with operation of the sewing machine, and hence a space must be reserved for retracting the movable member therein. Furthermore, when the combined hook portion picks up a thread from the lower looper, the thread therefrom tends to be caught in a gap defined between the upper looper and the separate movable member.

Thus, the known overlocking sewing machines even with the combined hook portion upper looper and movable member, are unable to form overlocked stitches of the described two types, reliably and smoothly, while permitting the change between stitch types to be quickly made.

It is therefore an object of the present invention to solve the foregoing problems encountered with the prior apparatus by providing an improved looper changeover device which enables the production of both single needle, three thread overlocked stitches and single needle, two thread overlocked stitches upon cooperation with a needle and a lower looper in a sewing machine.

This object and other objects, features and advantages of the present invention will become apparent from the following description when considered in connection with the accompanying drawings.

SUMMARY OF THE INVENTION

In general, the objects and advantages of the present invention are achieved by providing a looper changeover device for selectively positioning and retaining a looper which serves the functions of two different elements in positions for forming overlocked stitches with one needle and two threads or one needle and three threads. In the present invention, the looper changeover device comprises manually operable rotatable selector means for securing and selectively positioning a dual purpose looper with respect to holder means between a first position wherein the looper is moved by looper driving means along a first path and a second position wherein the looper is moved by the looper driving means along a second path for the selective production of overlocked stitches with one needle and three threads or one needle and two threads.

The looper with which the device of the present invention is particularly useful includes a distal portion which has a hook portion which is curved toward the lower looper of the sewing machine. The hook portion of the looper is defined by upper and lower distal end portions of the looper utilized as will be hereinafter described. The looper also includes an aperture capable of receiving and supporting a thread, the aperture being positioned close to the upper and lower distal end portions of the hook portion. The distal portion includes an upper looper portion which serves as an upper looper and a spreader portion which functions as a spreader upon the looper being placed in its appropriate position in accordance with the present invention. The spreader portion is defined by the hook portion and the lower distal end portion.

The looper is mounted movably on holder means, which can be a looper holder, the looper being movable with respect thereto by the device of the present invention and retainable thereby selectively in positions for forming overlocked stitches with one needle and two threads or one needle and three threads.

BRIEF DESCRIPTION OF THE DRAWINGS In the drawings.

DETAILED DESCRIPTION OF THE PREFERRED EMBODIMENT

Figure 1:
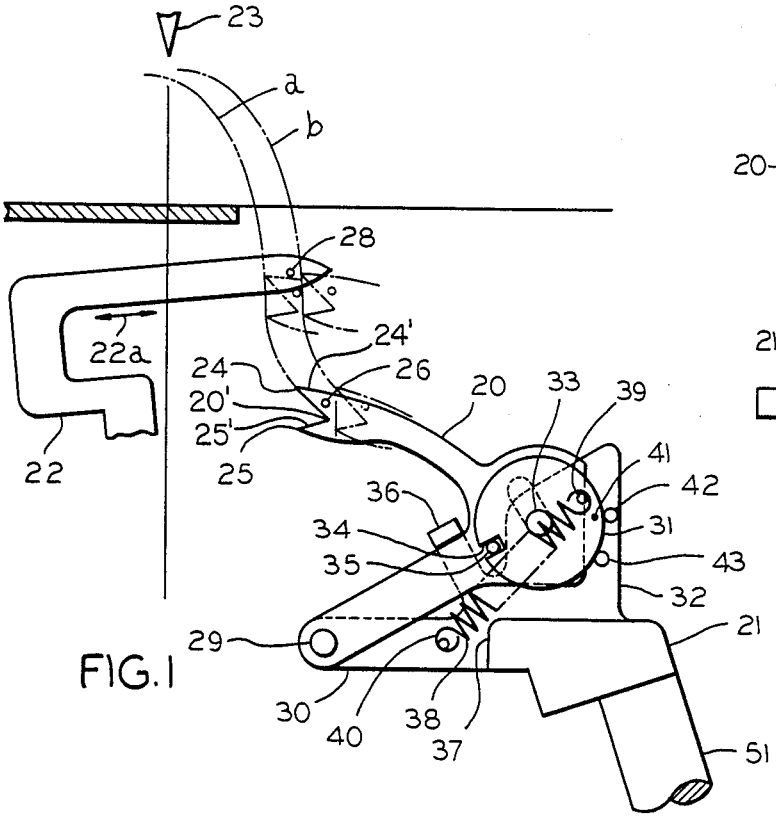
FIG. 1 is a front elevation view of a changeover device according to the present invention, showing several related elements, and illustrating the paths along which a looper positioned by the device is moved and positions of the looper therealong in broken lines.

Referring to the drawings and specifically to FIGS. 1–4, the numeral 20 designates generally a looper mounted on a looper holder 21. Looper holder 21 moves generally up and down to cause a distal end portion of the looper 20 to follow paths a or b (FIG. 1) while the sewing machine operates. A mechanism for driving the looper holder 21 will be hereinafter described.

A lower looper 22 is angularly movable about a shaft (not shown) disposed downwardly thereof for reciprocal movement in the directions of the arrows 22a. A sewing needle 23 is movable downwardly in front of the lower looper 22 as it is withdrawn rearwardly.

Figure 2:
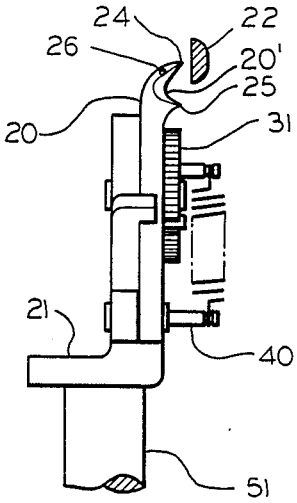
FIG. 2 is a side elevation view of the device of FIG. 1.
Figure 3:
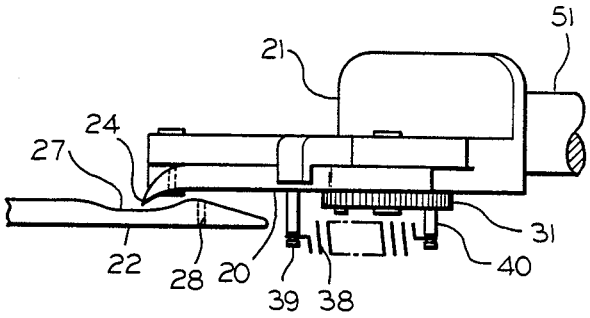
FIG. 3 is a top view of the device of FIG. 1.

Looper 20 has a hook portion 20′ between upper and lower distal end portions 24, 25, the hook portion 20′ including a spreader portion 25′, and an aperture 26 positioned closely to the distal end portions for passage of a thread therethrough. An upper looper portion 24′ formed by the upper surface of upper distal end portion 24 serves as an upper looper. The distal end portions 24, 25 are curved as shown in FIGS. 2 and 3 toward the lower looper 22 so as to pass into a shallow recess 27 in a side of the lower looper 22 such that a lower thread extending through a thread aperture 28 in the lower looper 22 can be picked up by either the upper looper portion 24′ or spreader portion 25′ of the hook portion 20′.

As shown in FIG. 1, the looper 20 has a lower portion bent downwardly and forwardly and having a lower end attached for angular movement by and about a pin 29 to a front end of a forward projecting arm 30 of the looper holder 21.

A rotatable disk or dial 31 is mounted on a support 32 on the looper holder 21 for angular i.e. rotatable, movement about a pin 33, the dial 31 having in a peripheral edge thereof a recess 34 in which is received a pin 35 fixed to the looper 20. Thus, rotatable movement of the disk 31 causes the looper 20 to move forwardly and rearwardly.

Looper holder 21 has a pair of stops 36, 37 for limiting the range of angular movement of the looper 20. The looper 20 is pressed against either the stops 36 or 37 by a tension spring 38 having one end coupled to a pin 39 on the disk 31 and the other to a pin 40 on the arm 30.

Upon rotation of the disk 31, an imaginary straight line passing through the pins 39, 40 is movable across the axis of the pin 33. When the disk 31 is in the position shown in FIG. 1, the looper 20 is retained in an advanced position by the stop 36 and is securely held in this position as the disk 31 is urged by the spring 38 to rotate clockwise as shown in FIG. 1. When the disk 31 is caused to rotate counterclockwise in FIG. 1, the pin 35 received in the recess 34 is moved to turn the looper 20 clockwise about the pin 29 into abutment against the stop 37, whereupon the distal ends 24, 25 are retracted to the broken line position shown in FIG. 1. At this time, the central axis of the spring 38 extends upwardly of the axis of the pin 29, thus urging the disk 31 to rotate counterclockwise. The looper 20 is now secured in position.

The disk 31 has a marking 41, and the support 32 has indications 42, 43, the arrangement being such that when the looper 20 is in the position for forming overlocked stitches with one needle and two threads, the marking 41 is in alignment with the indication 43, and when the looper 20 is in the position for producing overlocked stitches with one needle and three threads, the marking 41 is in alignment with the indication 42.

Figure 4:
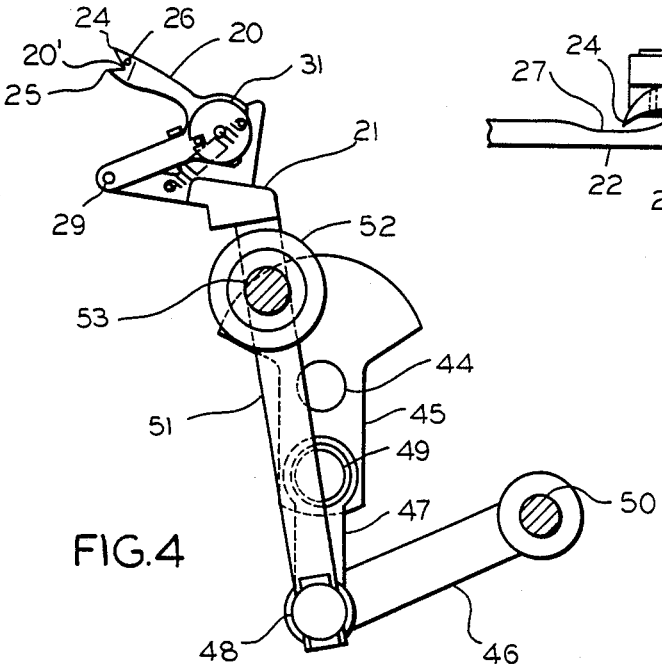
FIG. 4 is a front elevation view of the device of FIG. 1 illustrating supporting elements and a portion of the driving means for the looper.

The looper holder 21, and hence looper 20, can be operated in a sewing operation by a looper driving mechanism as shown in FIG. 4. The looper driving mechanism comprises a drive shaft 44 located in a lower portion of the sewing machine, a crank 45 fixed to the shaft 44, a swingable lever 46 connected at a front end thereof to one end of a connector link 47 by a pin 48, the other end of which is connected by a pin 49 to an end of the crank 45, the swingable lever 46 having a rear end connected to a shaft 50 rotatably journaled in a bearing (not shown) disposed downwardly of a bed of the sewing machine. To the front end of the lever 46, there is attached by the pin 48 a lower end of a looper supporting rod 51 which slidably extends through a guide hole in a guide member 52 that is anularly movably mounted on a shaft 53 attached to a support disposed downwardly of the sewing machine bed. When the drive shaft rotates, the lever 46 is caused by the connector link 47 to turn about the shaft 50, whereupon the looper supporting rod 51 moves up and down as it swings about the shaft 53, causing the looper 20 on the looper holder 21 to have the upper distal end 24 follow the path a or b in FIG. 1.

The looper driving apparatus illustrated is by way of example only, and various other mechanisms may be employed for actuating the looper.

The sewing machine having the looper changeover device according to the present invention operates as follows:

When the disk 31 is rotated until the marking 41 thereon is in alignment with the indication 42 bringing the looper 20 into the solid-line position shown in FIG. 1, the sewing machine can form overlocked stitches with one needle and three threads.

Figure 5:
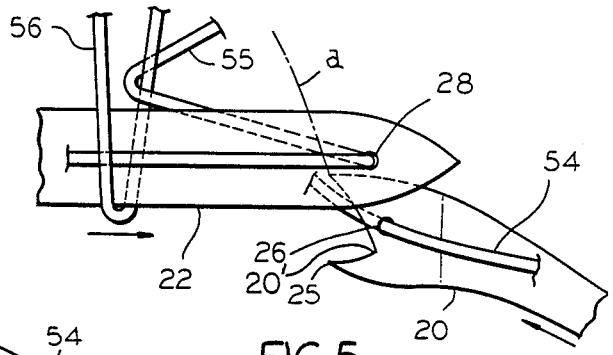
FIG. 5 is an enlarged front elevation view illustrating one step in the formation of a stitch with the device of the present invention.
Figure 6:
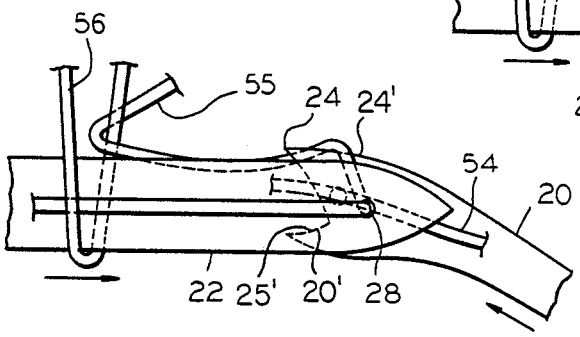
FIG. 6 is an enlarged front elevation view of another step in the formation of a stitch with the device of the present invention.
Figure 7:
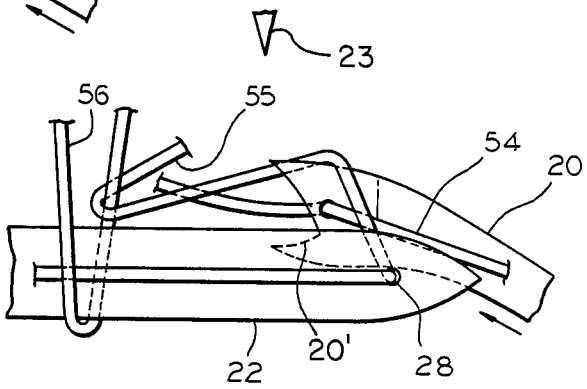
FIG. 7 is an enlarged front elevation view of still another step in the formation of a stitch with the device of the present invention.

To effect this stitch, an upper thread 54 is threaded through the thread aperture 26 in the looper 20, a lower thread 55 is threaded through the thread aperture 28 in the lower looper 22, and a needle thread 56 is threaded through the sewing needle 23. As the sewing machine is operated, the upper distal end 24 of the looper 20 moves along path a of FIG. 1 and meets the lower looper 22. On travel along the path, the upper distal end 24 of the looper 20 passes under the lower thread 55 carried by lower looper 22 as the latter moves forward, as illustrated successively in FIGS. 5, 6, and 7. The looper 20 moves upwardly with the lower thread 55 carried thereover by the upper distal surface of looper 20 to bring the upper thread 54 passing through the thread aperture 28 under the lower thread 55 until the looper 20 reaches a position in which it meets the needle 23, whereupon the upper thread 54 is caught by the needle. Then, the looper 20 is lowered and the lower looper 22 is retracted, forming an overlocked stitch with one needle and three threads.

When the disk 31 is rotated to bring the marking 41 thereon into alignment with the indication 43, thereby retracting the looper 20 to the broken line position illustrated in FIG. 1, and the looper 20 is thereby fixed to the looper holder 21 in such position, the distal end of the looper 20 follows the path b for forming overlocked stitches with one needle and two threads.

Figure 8:
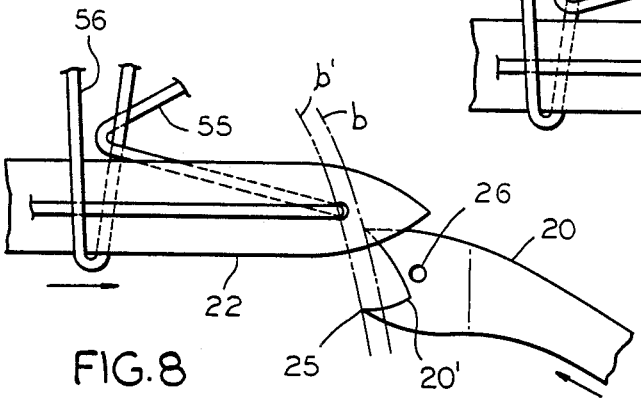
FIG. 8 is an enlarged front elevation view illustrating one step in the formation of a second stitch with the device of the present invention.
Figure 9:
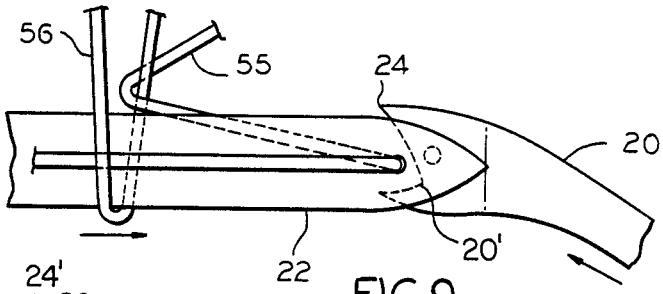
FIG. 9 is an enlarged front elevation view of another step in the formation of a second stitch with the device of the present invention.
Figure 10:
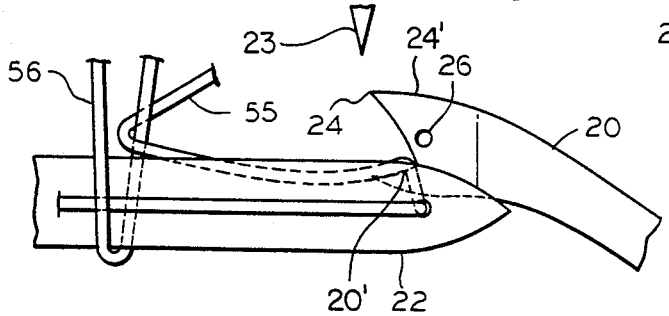
FIG. 10 is an enlarged front elevation view of still another step in the formation of a second stitch with the device of the present invention.

More specifically, the sewing machine is operated with the lower thread 55 and the needle thread 56 in place, but with the upper thread 54 removed. The hook portion 20' of the looper 20 move upwardly as hook portion 20' picks up the lower thread 55 passing through the lower looper 22, as shown in FIGS. 8, 9 and 10. The looper 20 continues to move upwardly with the lower thread 55 caught between the distal ends 24, 25 of the looper 20 (hook portin 20') until the looper 20 meets the sewing needle 23 as the latter is lowered, whereupon the lower thread 55 is caught by the sewing needle 23. Thereafter, the looper 20 is moved downwardly and the lower looper 22 is withdrawn to produce an overlocked stitch with one needle and two threads.

Stated otherwise, the upper distal end portion 24 of the looper 20 following the path b in which the distal end portion 24 does not meet the lower looper 22 to pick up the lower thread 21 as shown in FIG. 8. Instead, the lower distal end portion 25 moves along a path b' to pick up the lower thread 55, thus producing an overlocked stitch with one needle and two threads.

With the device of present invention, as described above, the looper serving as a spreader for forming overlocked stitches with one needle and two threads and as an upper looper for forming overlocked stitches with one needle and three stitches, is readily movable relatively slightly back and forth and can be fixed in a selected position. Looper 20 is angularly movably mounted and selectively positioned on the looper holder 21 by the relatively simple mechanism of the present invention for producing overlocked stitches with one needle and three threads and with one needle and two threads.

With the arrangement of the present invention, the distal end portions 24, 25 of the looper can be moved back and forth simply by the changeover device through the movement of the looper through a small angular interval. The disk or dial mechanism mounted on the looper holder 21 allows the looper 20 to move forwardly or rearwardly and to be secured in a selected position in response to angular or rotatable movement of the disk 31. The positions for forming overlocked stitches with one needle and two threads and one needle and three threads can be easily identified by the marking on the disk or dial as it is aligned or coincides with the indications on the support or holder 21. The position of the looper 20 can thus be changed with utmost ease.

We claim:

1. In a looper changeover device, for a sewing machine including a sewing needle, a lower looper, another looper, looper driving means, and holder means for securing said other looper to said driving means therefor, said needle, lower looper and other looper being cooperatively operable to produce overlocked stitches, the improvement comprising manually operable, rotatable selector means for securing and selectively positioning said other looper with respect to said holder means between a first position wherein said looper is moved by said driving means therefor along a first path and a second position wherein said looper is moved by said driving means along a second path for the selective production of overlocked stitches with one needle and three threads or one needle and two threads, said other looper having a distal portion having an upper looper portion and a spreader portion including a hook portion which are selectively movable along said first and second paths as determined by said selector means.

2. The looper changeover device defined in claim 1 wherein said other looper is angularly, movably mounted on said holder means for movement by said selector means between said first and second positions with respect to said holder means.

3. The looper changeover device defined in claim 1 wherein said other looper having a hook portion includes an aperture positioned closely to the distal portion capable of supporting a thread for movement therewith.

4. The looper changeover device defined in claim 1, wherein said rotatable selector means comprises a rotatable disk supported by said holder means and engaging a portion of said other looper for positioning and securing the said other looper in either of said first and second positions.

5. The looper changeover device defined in claim 4, wherein the rotatable selector means includes an indicator for indicating the location of said other looper and said hook portion in either of said first or second positions for the production of overlocked stitches of either one needle and three threads or one needle and two threads.

6. The looper changeover device defined in claim 4, wherein the rotatable selector means includes a pin mounted on said looper and received in a recess defined by the peripheral edge of said disk, whereby rotation of said disk caused said pin and said other looper to be moved angularly with respect to said looper holder.

7. The looper changeover device defined in claim 4, wherein the looper holder includes a pair of stops against which a portion of said other looper abuts upon the looper being positioned in either of said first and second portions.

* * * * *

UNITED STATES PATENT AND TRADEMARK OFFICE

CERTIFICATE OF CORRECTION

PATENT NO. : 4,799,440

DATED : January 24, 1989

INVENTOR(S) : Koshinaka et al.

It is certified that error appears in the above-identified patent and that said Letters Patent is hereby corrected as shown below:

Title Page:
In the Abstract, first line, "maching" should read --machine--.

Column 2, lines 38-39, "In the drawings" should be deleted.

Column 2, line 53, "looper:" should read --looper;--.

Column 4, line 21, "anularly" should read --angularly--.

Column 5, line 4, "The hook portion 20′ of the looper 20" should read --The hook portion 20′ and spreader portion 25′ of the looper 20--.

Column 5, line 9, "portin" should read --portion--.

Column 5, line 26, "stitches" should read --threads--.

Column 6, line 18, "claim 1" should read --claim 1,--.

Column 6, line 23, "claim 1" should read --claim 1,--.

UNITED STATES PATENT AND TRADEMARK OFFICE

CERTIFICATE OF CORRECTION

PATENT NO. : 4,799,440

DATED : January 24, 1989

INVENTOR(S) : Koshinaka et al.

It is certified that error appears in the above-identified patent and that said Letters Patent is hereby corrected as shown below:

Column 6, line 45, "caused" should read --causes--.

Signed and Sealed this

Fourth Day of September, 1990

*Attest:*

HARRY F. MANBECK, JR.

*Attesting Officer*

*Commissioner of Patents and Trademarks*